US008517703B2

(12) United States Patent
Doepker

(10) Patent No.: US 8,517,703 B2
(45) Date of Patent: Aug. 27, 2013

(54) COMPRESSOR INCLUDING VALVE ASSEMBLY

(75) Inventor: Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 271 days.

(21) Appl. No.: 13/032,179

(22) Filed: Feb. 22, 2011

(65) Prior Publication Data

US 2011/0206548 A1 Aug. 25, 2011

Related U.S. Application Data

(60) Provisional application No. 61/307,135, filed on Feb. 23, 2010.

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/55.1; 418/15; 418/55.5; 418/57; 418/180; 417/304; 417/310; 417/410.5; 137/511; 137/514.7; 137/529; 137/540

(58) Field of Classification Search

USPC ..... 418/15, 55.1–55.6, 57, 180, 270, 418/DIG. 1; 417/304, 310, 410.5, 440; 137/514.5, 514.7, 540, 529, 511

See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |
| 4,497,615 | A | 2/1985 | Griffith |
| 4,774,816 | A | 10/1988 | Uchikawa et al. |
| 4,818,195 | A | 4/1989 | Murayama et al. |
| 4,846,633 | A | 7/1989 | Suzuki et al. |

(Continued)

FOREIGN PATENT DOCUMENTS

| | | | | |
|---|---|---|---|---|
| JP | 63205482 A | * | 8/1988 | ..... 418/55.1 |
| JP | 03081588 A | | 4/1991 | |

(Continued)

OTHER PUBLICATIONS

International Search Report regarding Application No. PCT/US2011/025921, mailed Oct. 7, 2011.

(Continued)

*Primary Examiner* — Theresa Trieu

(74) *Attorney, Agent, or Firm* — Harness, Dickey & Pierce, P.L.C.

(57) ABSTRACT

A compressor hub assembly may include a hub member, a valve retainer and a valve member. The hub member may include first and second portions. The first portion may define an annular hub wall for a compressor and may have a first inner diameter. The second portion may have a second inner diameter greater than the first inner diameter and may define a stepped region between the first and second portions. The valve retainer may be fixed to the hub member at an end of the second portion opposite the stepped region and may define a third inner diameter. The valve member may be located between the valve retainer in the stepped region and may have an outer diameter less than the second inner diameter and greater than the first and third inner diameters.

21 Claims, 6 Drawing Sheets

(56) References Cited

U.S. PATENT DOCUMENTS

| | | | | |
|---|---|---|---|---|
| 4,886,425 | A | 12/1989 | Itahana et al. | |
| 4,940,395 | A | 7/1990 | Yamamoto et al. | |
| 5,059,098 | A | 10/1991 | Suzuki et al. | |
| 5,071,323 | A * | 12/1991 | Sakashita et al. | 418/55.1 |
| 5,074,760 | A | 12/1991 | Hirooka et al. | |
| RE34,148 | E | 12/1992 | Terauchi et al. | |
| 5,169,294 | A | 12/1992 | Barito | |
| 5,192,195 | A | 3/1993 | Iio et al. | |
| 5,193,987 | A | 3/1993 | Iio et al. | |
| 5,240,389 | A | 8/1993 | Oikawa et al. | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,613,841 | A * | 3/1997 | Bass et al. | 417/310 |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,741,120 | A | 4/1998 | Bass et al. | |
| 5,855,475 | A * | 1/1999 | Fujio et al. | 418/55.1 |
| 5,885,063 | A | 3/1999 | Makino et al. | |
| 5,993,171 | A | 11/1999 | Higashiyama | |
| 5,993,177 | A | 11/1999 | Terauchi et al. | |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,149,401 | A | 11/2000 | Iwanami et al. | |
| 6,164,940 | A | 12/2000 | Terauchi et al. | |
| 6,176,686 | B1 | 1/2001 | Wallis et al. | |
| 6,210,120 | B1 | 4/2001 | Hugenroth et al. | |
| 6,213,731 | B1 * | 4/2001 | Doepker et al. | 417/310 |
| 6,231,316 | B1 | 5/2001 | Wakisaka et al. | |
| 6,273,691 | B1 * | 8/2001 | Morimoto et al. | 418/15 |
| 6,293,767 | B1 | 9/2001 | Bass | |
| 6,322,340 | B1 | 11/2001 | Itoh et al. | |
| 6,350,111 | B1 | 2/2002 | Perevozchikov et al. | |
| 6,379,123 | B1 | 4/2002 | Makino et al. | |
| 6,412,293 | B1 | 7/2002 | Pham et al. | |
| 6,413,058 | B1 | 7/2002 | Williams et al. | |
| 6,419,457 | B1 | 7/2002 | Seibel et al. | |
| 6,428,286 | B1 | 8/2002 | Shimizu et al. | |
| 6,454,551 | B2 | 9/2002 | Kuroki et al. | |
| 6,457,948 | B1 | 10/2002 | Pham | |
| 6,464,481 | B2 | 10/2002 | Tsubai et al. | |
| 6,478,550 | B2 | 11/2002 | Matsuba et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,715,999 | B2 | 4/2004 | Ancel et al. | |
| 6,769,888 | B2 | 8/2004 | Tsubono et al. | |
| 6,817,847 | B2 | 11/2004 | Agner | |
| 6,863,510 | B2 | 3/2005 | Cho | |
| 6,881,046 | B2 | 4/2005 | Shibamoto et al. | |
| 6,884,042 | B2 | 4/2005 | Zili et al. | |
| 6,913,448 | B2 | 7/2005 | Liang et al. | |
| 6,984,114 | B2 | 1/2006 | Zili et al. | |
| 7,018,180 | B2 | 3/2006 | Koo | |
| 7,029,251 | B2 | 4/2006 | Chang et al. | |
| 7,118,358 | B2 | 10/2006 | Tsubono et al. | |
| 7,137,796 | B2 | 11/2006 | Tsubono et al. | |
| 7,207,787 | B2 | 4/2007 | Liang et al. | |
| 7,229,261 | B2 | 6/2007 | Morimoto et al. | |
| 7,261,527 | B2 | 8/2007 | Alexander et al. | |
| 7,344,365 | B2 | 3/2008 | Takeuchi et al. | |
| 7,354,259 | B2 | 4/2008 | Tsubono et al. | |
| 7,364,416 | B2 | 4/2008 | Liang et al. | |
| 7,371,057 | B2 | 5/2008 | Shin et al. | |
| 7,393,190 | B2 | 7/2008 | Lee et al. | |
| 7,404,706 | B2 | 7/2008 | Ishikawa et al. | |
| 7,547,202 | B2 | 6/2009 | Knapke | |
| 7,717,687 | B2 | 5/2010 | Reinhart | |
| 2001/0010800 | A1 | 8/2001 | Kohsokabe et al. | |
| 2002/0039540 | A1 | 4/2002 | Kuroki et al. | |
| 2004/0136854 | A1 | 7/2004 | Kimura et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0019178 | A1 | 1/2005 | Shin et al. | |
| 2005/0053507 | A1 | 3/2005 | Takeuchi et al. | |
| 2006/0228243 | A1 | 10/2006 | Sun et al. | |
| 2007/0036661 | A1 | 2/2007 | Stover | |
| 2008/0159892 | A1 | 7/2008 | Huang et al. | |
| 2009/0068048 | A1 | 3/2009 | Stover et al. | |
| 2009/0071183 | A1 | 3/2009 | Stover et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0300659 | A1 | 12/2010 | Stover et al. | |
| 2010/0303659 | A1 | 12/2010 | Stover et al. | |

FOREIGN PATENT DOCUMENTS

| | | | |
|---|---|---|---|
| JP | 08334094 | A | 12/1996 |
| JP | 2000161263 | A | 6/2000 |
| JP | 2003106258 | A | 4/2003 |
| JP | 2003227479 | A | 8/2003 |
| JP | 2007154761 | A | 6/2007 |
| JP | 2008248775 | A | 10/2008 |

OTHER PUBLICATIONS

Written Opinion of the International Search Authority regarding Application No. PCT/US2011/025921, mailed Oct. 7, 2011.

Written Opinion of the International Searching Authority regarding Application No. PCT/US2010/030248, mailed Nov. 26, 2010.

International Search Report regarding Application No. PCT/US2010/030248, mailed Nov. 26, 2010.

* cited by examiner

COMPRESSOR INCLUDING VALVE ASSEMBLY

CROSS-REFERENCE TO RELATED APPLICATIONS

This application claims the benefit of U.S. Provisional Application No. 61/307,135, filed on Feb. 23, 2010. The entire disclosure of the above application is incorporated herein by reference.

FIELD

The present disclosure relates to compressors.

BACKGROUND

This section provides background information related to the present disclosure which is not necessarily prior art.

Scroll compressors include a variety of valve assemblies to control compressor discharge conditions. The valve assemblies may include numerous parts resulting in a complex assembly process. Additionally, some compressors may include multiple valve assemblies, further complicating assembly.

SUMMARY

A compressor may include a first scroll member, a second scroll member, a hub member and a valve member. The first scroll member may include a first end plate having a first spiral wrap extending therefrom. The first end plate may include a first annular wall surrounding a first region located radially within the first annular wall and a second region located radially within the first region and defining a recess. The first end plate may further define a discharge port and a first bypass port extending through the recess. The second scroll member may be supported relative to the first scroll member and may include a second end plate having a second spiral wrap extending therefrom and meshingly engaged with the first spiral wrap to form a suction pocket, intermediate pockets, and a discharge pocket. The discharge port may be in communication with the discharge pocket and the first bypass port may be in communication with the one of the intermediate pockets. The hub member may be secured to the first end plate and may overlie an end surface defined by the second region. The hub member may include a second annular wall defining a discharge passage in communication with the discharge port. The valve member may be located between the first end surface and the hub member and may be displaceable between a closed position where the valve member prevents communication between the first bypass port and a discharge passage and an open position where the first bypass port is in communication with the discharge passage.

The valve member may include an annular body defining an outer diameter greater than an inner diameter defined by the second annular wall and the second annular wall may form a valve stop for the valve member. The annular body may define an aperture aligned with the discharge port and may provide communication between the discharge port and the discharge passage when the valve member is in the open and closed positions.

The compressor may further include a valve retainer fixed to an end of the hub member opposite the second annular wall. The hub member may define a stepped region between the valve retainer and the second annular wall and the valve member may be axially retained between the valve retainer and the stepped region. The valve retainer may include an annular body defining an inner circumference having a diameter less than the outer diameter of the valve member.

The compressor may further include a biasing member axially retained within the hub member and biasing the valve member to the closed position. The compressor may further include a discharge valve fixed to the hub member within the discharge passage and displaceable between an open position allowing flow from the discharge port through the discharge passage and a closed position preventing flow from the discharge passage to the discharge port. A protrusion may extend axially outward from the first end surface of the recess and the bypass port may extend through the protrusion. The valve retainer may be located radially outward from the protrusion and may have a thickness less than the axial extent of the protrusion. The valve retainer may be located axially between the end surface and an end of the protrusion.

The first end plate may include a stepped region defining a sidewall radially between the first and second regions. The sidewall may include a threading engaged with a threading on an outer circumference of the hub member. The hub member may include a tool engagement region formed in an inner circumference of the second annular wall adapted to be rotationally driven by a tool to provide the threaded engagement.

In another arrangement, the hub member may include a flange extending radially outward from the second annular wall and overlying the first region. The hub member may be fixed to the first scroll member by a fastener extending through the flange and into the first end plate. The compressor may further include a seal assembly engaged with the first and second annular walls to define a biasing chamber. The first region may include a biasing passage extending therethrough and in communication with one of the intermediate pockets.

A compressor hub assembly may include a hub member, a valve retainer and a valve member. The hub member may include first and second portions. The first portion may define an annular hub wall for a compressor and may have a first inner diameter. The second portion may have a second inner diameter greater than the first inner diameter and may define a stepped region between the first and second portions. The valve retainer may be fixed to the hub member at an end of the second portion opposite the stepped region and may define a third inner diameter. The valve member may be located between the valve retainer in the stepped region and may have an outer diameter less than the second inner diameter and greater than the first and third inner diameters.

An outer diameter of the first portion of the hub member may be less than an outer diameter of the second portion defining an outer stepped region between the first and second portions. The compressor hub assembly may further include a discharge valve fixed to the hub member within the annular wall. The second portion of the hub member may include a threading on an inner circumference thereof. The first portion may include a tool engagement region in an inner circumference of the annular hub wall adapted to be rotationally driven by a tool. In another arrangement, the hub member may include a flange extending radially outward from the annular hub wall and including an aperture adapted to receive a fastener to fix the hub assembly to a scroll member.

A method according to the present disclosure may include providing a valve member within a hub member. The hub member may include a first portion and a second portion. The first portion may define an annular hub wall for a compressor and may have a first inner diameter. The second portion may have a second inner diameter greater than the first inner diameter. The first and second portions may define a stepped region therebetween with the valve member being located within the second portion. The method may further include securing a valve retainer to an end of the second portion of the hub member to retain the valve member between the stepped region and the valve retainer. The method may further include coupling the hub member to a scroll member within an outer annular wall of the scroll member after the securing.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
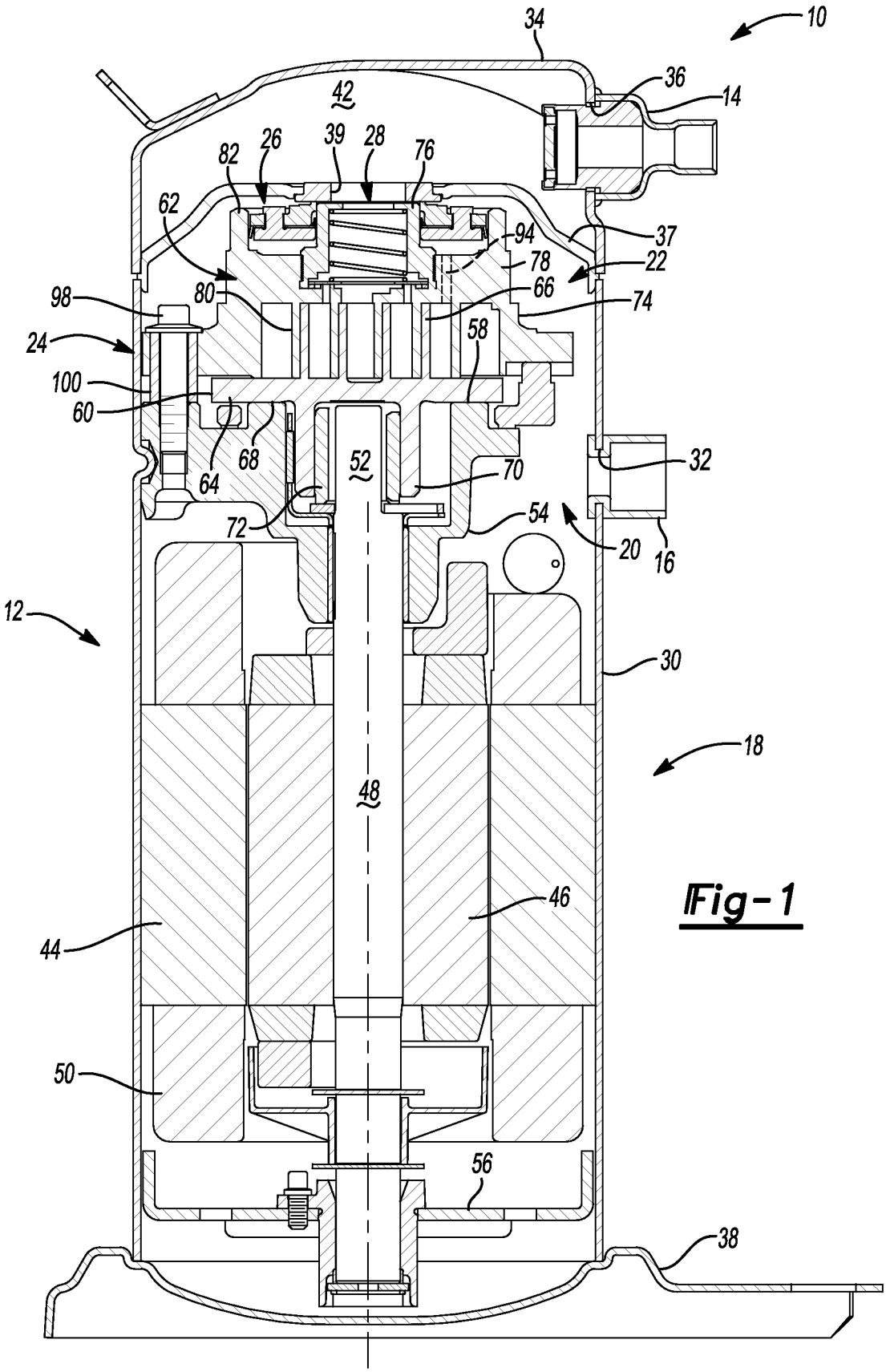
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features. The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to FIG. 1, compressor 10 may include a housing 12, a refrigerant discharge fitting 14, a suction gas inlet fitting 16, a motor assembly 18, a bearing housing assembly 20, a compression mechanism 22, a retaining assembly 24, a seal assembly 26, and a valve assembly 28.

Housing 12 may house motor assembly 18, bearing housing assembly 20, and compression mechanism 22. Housing 12 may include a longitudinally extending shell 30 having a suction gas inlet 32, an end cap 34 having a discharge gas outlet 36, a transversely extending partition 37, and a base 38. End cap 34 may be fixed to an upper end of shell 30. Base 38 may be fixed to a lower end of shell 30. End cap 34 and partition 37 may generally define a discharge chamber 42. Partition 37 may include an aperture 39 providing communication between compression mechanism 22 and discharge chamber 42. Discharge chamber 42 may generally form a discharge muffler for compressor 10. Refrigerant discharge fitting 14 may be attached to housing 12 at discharge gas outlet 36 in end cap 34. Suction gas inlet fitting 16 may be attached to shell 30 at suction gas inlet 32. While illustrated as including a discharge chamber 42, it is understood that the present disclosure is not limited to compressors having discharge chambers and applies equally to direct discharge configurations.

Motor assembly 18 may generally include a motor stator 44, a rotor 46, and a drive shaft 48. Windings 50 may pass through stator 44. Motor stator 44 may be press fit into shell 30. Drive shaft 48 may be rotatably driven by rotor 46 and supported by the bearing housing assembly 20. Drive shaft 48 may include an eccentric crank pin 52 having a flat thereon for driving engagement with compression mechanism 22. Rotor 46 may be press fit on drive shaft 48. Bearing housing assembly 20 may include a main bearing housing 54 and a lower bearing housing 56 fixed within shell 30. Main bearing housing 54 may include an annular flat thrust bearing surface 58 that supports compression mechanism 22 thereon.

Compression mechanism 22 may be driven by motor assembly 18 and may generally include an orbiting scroll 60 and a non-orbiting scroll assembly 62. Orbiting scroll 60 may include an end plate 64 having a spiral vane or wrap 66 on the upper surface thereof and an annular flat thrust surface 68 on the lower surface. Thrust surface 68 may interface with an annular flat thrust bearing surface 58 on main bearing housing 54. A cylindrical hub 70 may project downwardly from thrust surface 68 and may have a drive bushing 72 rotatively disposed therein. Drive bushing 72 may include an inner bore in which crank pin 52 is drivingly disposed. Crank pin 52 may drivingly engage a flat surface in a portion of the inner bore of drive bushing 72 to provide a radially compliant driving arrangement.

Figure 2:
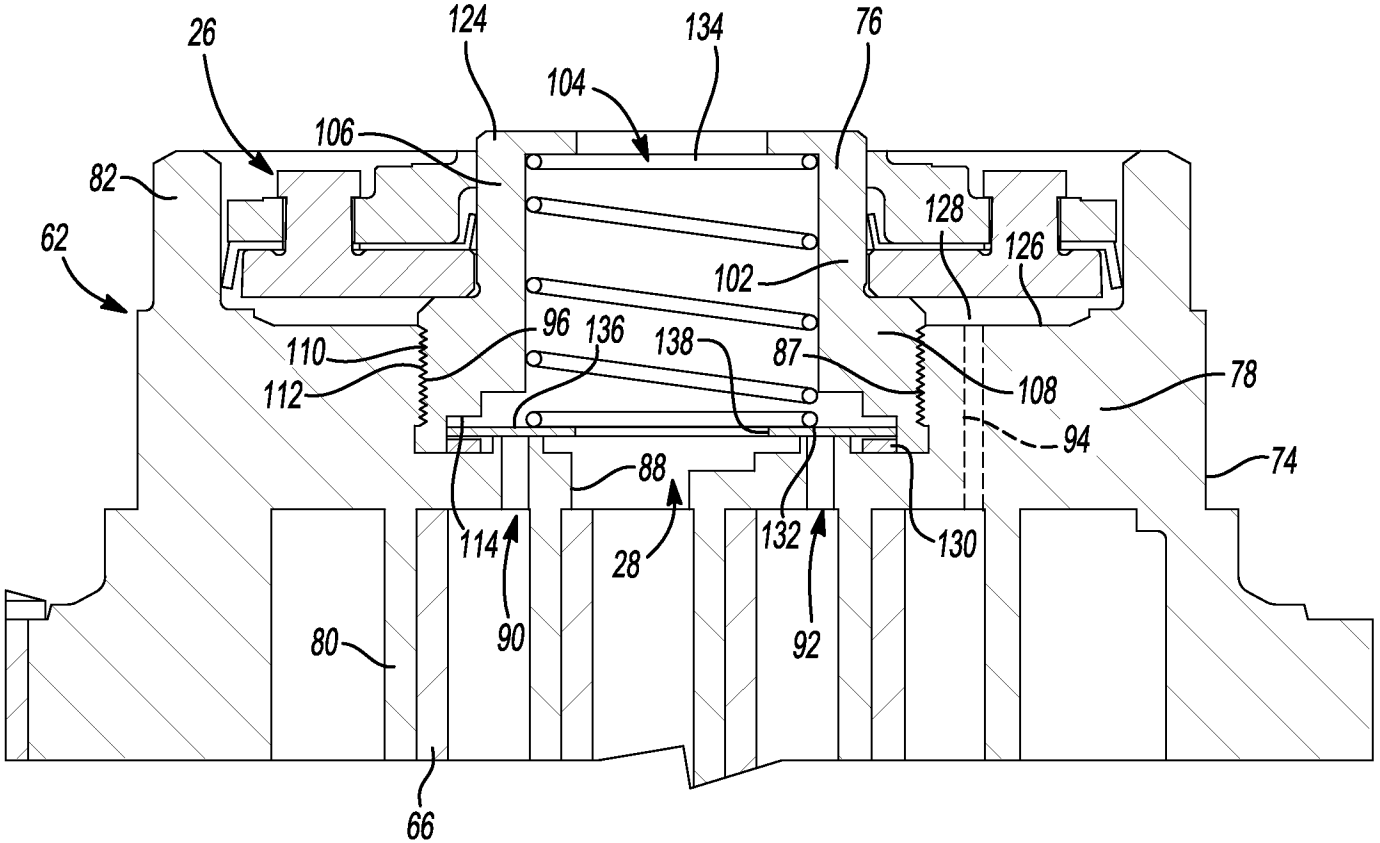
FIG. 2 is a fragmentary section view of the compressor of FIG. 1.
Figure 3:
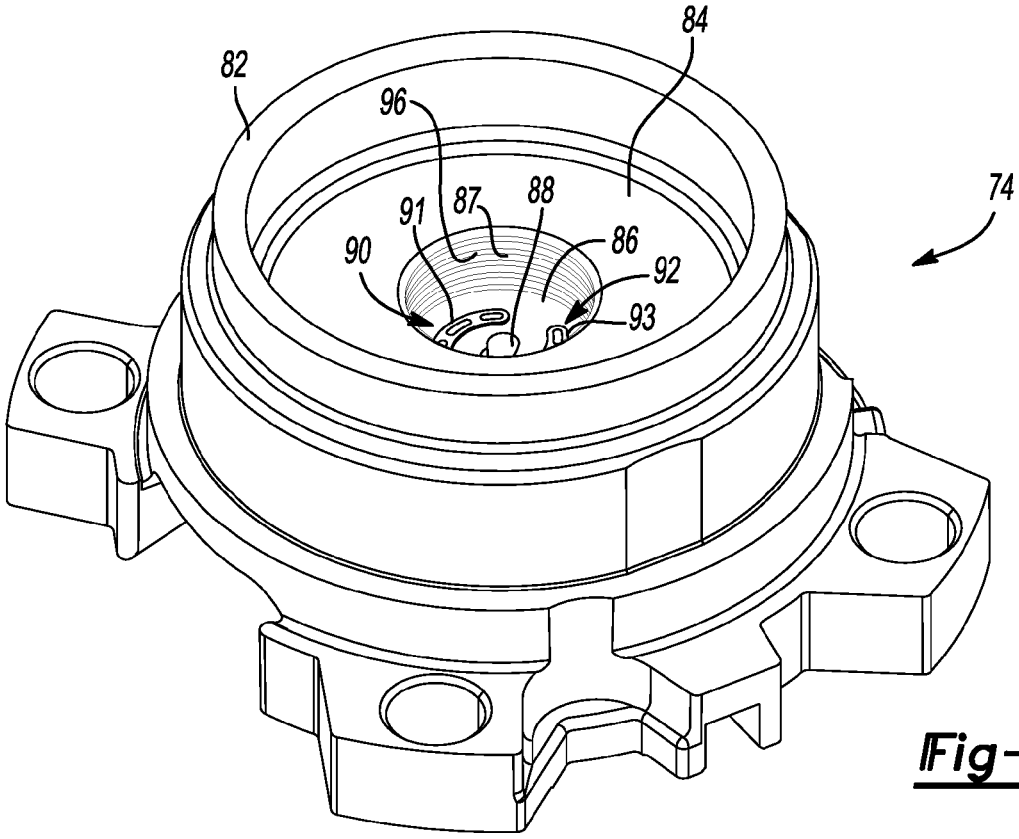
FIG. 3 is a perspective view of the non-orbiting scroll member of the compressor of FIG. 1.

As seen in FIGS. 2 and 3, non-orbiting scroll assembly 62 may include a non-orbiting scroll member 74 and a hub member 76. Non-orbiting scroll member 74 may include an end plate 78, a spiral wrap 80, and a first annular wall 82. A first region 84 of end plate 78 may be located radially within first annular wall 82 and a second region 86 of end plate 78 may be located radially within first region 84. Second region 86 may define a recess forming a stepped region between the first and second regions 84, 86. A primary discharge port 88 and first and second bypass porting 90, 92 may be located within the recess defined by second region 86. More specifically, second region 86 may include a wall 87 surrounding primary discharge port 88 and first and second bypass porting 90, 92. Wall 87 may include a threading 96 thereon for engagement with the hub member 76. First and second bypass porting 90, 92 may be located in protrusions 91, 93 extending from an end surface of the recess defined by second region 86 and may form variable volume ratio (VVR) ports. A biasing passage 94 may be located radially between first annular wall 82 and wall 87.

Spiral wrap 80 may form a meshing engagement with wrap 66 of orbiting scroll 60, thereby creating a series of pockets. The pockets created by spiral wraps 66, 80 may change throughout a compression cycle of compression mechanism 22 and may include a suction pocket, intermediate pockets and a discharge pocket.

Primary discharge port 88 may be in communication with the discharge pocket, the first and second bypass porting 90, 92 may be in communication with intermediate pockets or the discharge pocket, and biasing passage 94 may also be in communication with an intermediate pocket. The biasing passage 94 may be located radially outward relative to the first and second bypass porting 90, 92. Non-orbiting scroll member 74 may be rotationally fixed relative to main bearing housing 54 by retaining assembly 24 for limited axial displacement based on pressurized gas from biasing passage 94. Retaining assembly 24 may generally include a fastener 98 and a bushing 100 extending through non-orbiting scroll member 74. Fastener 98 may be fixed to main bearing housing 54.

Figure 4:
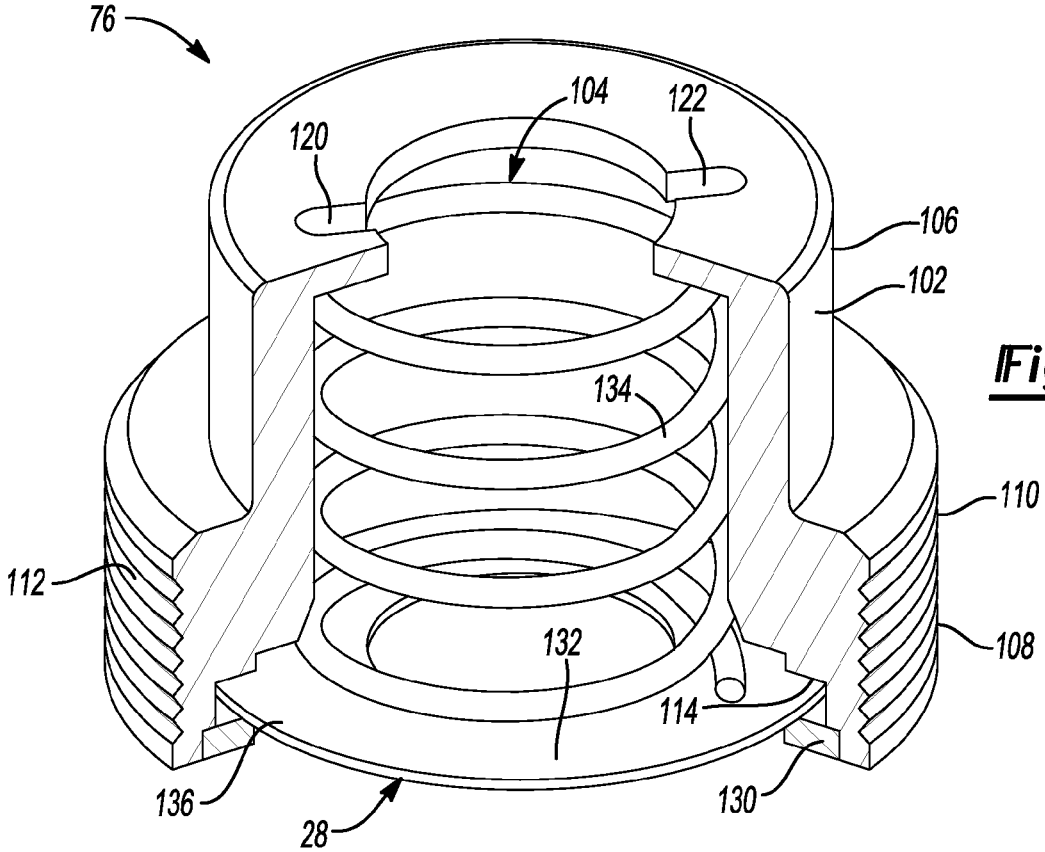
FIG. 4 is a perspective fragmentary section illustration of a hub assembly and valve assembly of the compressor of FIG. 1.

Referring to FIGS. 2 and 4, hub member 76 may include a generally annular body 102 defining a discharge passage 104 that forms a discharge pressure region in communication with primary discharge port 88 and discharge chamber 42. Hub member 76 may include first and second portions 106, 108. Second portion 108 may have an outer surface 110 including a threading 112 for engagement with threading 96 on wall 87. A valve stop 114 may be defined within discharge port 88. More specifically, valve stop 114 may be defined by a stepped region between first and second portions 106, 108.

The stepped region may be formed by an end of second portion 108 having a greater inner diameter than first portion 106. An outer stepped region may additionally be formed by second portion 108 having a greater outer diameter than first portion 106. An end of hub member 76 may include a tool engagement region defining slots 120, 122 extending radially outwardly from an inner circumference for engagement with a driver (not shown) during assembly of compressor 10. First portion 106 of hub member 76 may form a second annular wall 124 that is located radially inward relative to first annular wall 82. First and second annular walls 82, 124 and end plate 78 may cooperate to form an annular recess 126 for axial biasing of non-orbiting scroll assembly 62.

Seal assembly 26 may be disposed within annular recess 126 and may be sealingly engaged with first and second annular walls 82, 124 and partition 37 to form an annular chamber 128 that is in communication with biasing passage 94 and that is isolated from suction and discharge pressure regions of compressor 10.

Hub member 76 and valve assembly 28 may form a hub assembly. Valve assembly 28 may be located within hub member 76 and may include a retainer 130, a valve member 132, and a biasing member 134. More specifically, valve assembly 28 may be located within discharge passage 104 defined by hub member 76. Retainer 130 may be fixed to an end of second portion 108 of hub member 76 and valve member 132 may be located and axially retained between valve stop 114 and retainer 130. Retainer 130 may have an axial thickness that is less than the height of protrusions 91, 93 and may be located radially outward therefrom. Valve member 132 may be displaceable between open and closed positions and may be initially biased into a closed position by biasing member 134. Biasing member 134 may take a variety of forms including, but not limited to, helical, crescent washer or wave washer type springs.

Figure 7:
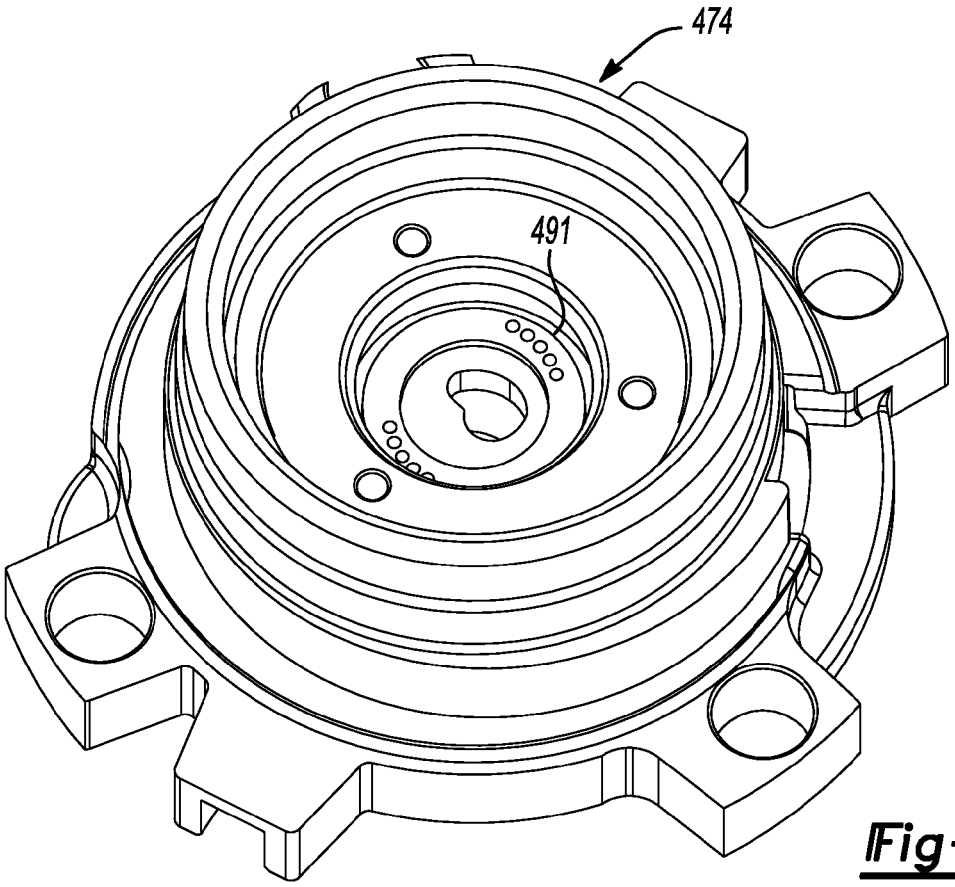
FIG. 7 is a perspective view of an alternate non-orbiting scroll member according to the present disclosure.
Figure 8:
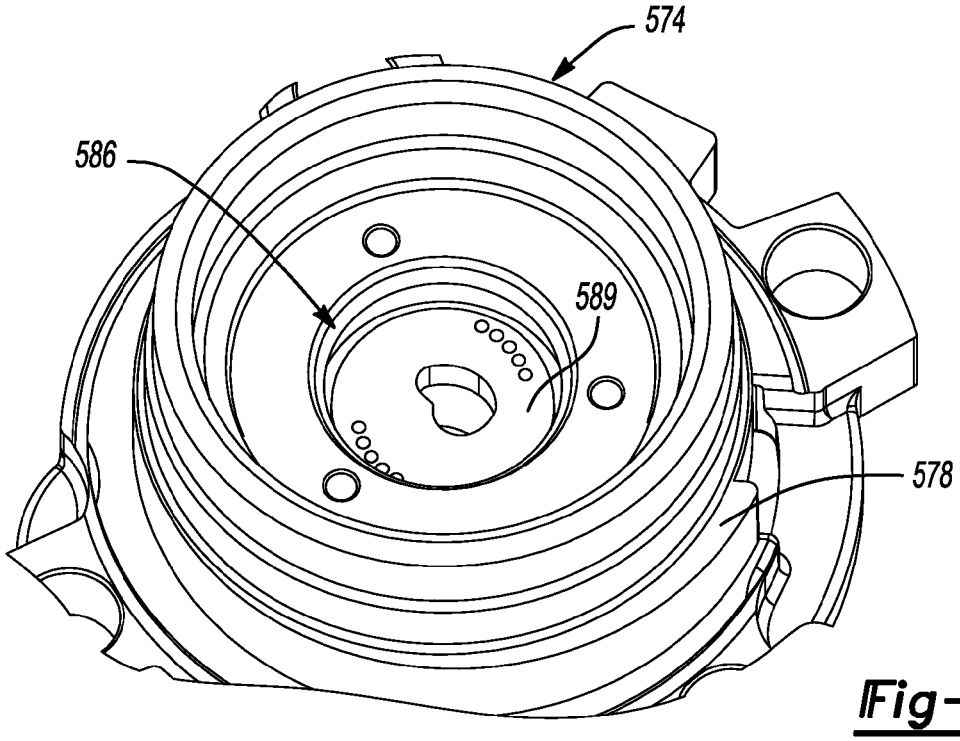
FIG. 8 is a perspective view of an alternate non-orbiting scroll member according to the present disclosure.

Valve member 132 may include an annular body 136 that defines an aperture 138. Annular body 136 may be radially aligned with first and second bypass porting 90, 92 and aperture 138 may be radially aligned with primary discharge port 88. When in the closed position, valve member 132 may sealingly engage protrusions 91, 93 to seal bypass porting 90, 92 from communication with discharge passage 104 of hub member 76. In an alternate arrangement shown in FIG. 7, non-orbiting scroll member 474 may include a continuous annular protrusion 491 forming a valve seating region instead of the discrete protrusions 91, 93 shown in FIG. 3. In another alternate arrangement shown in FIG. 8, non-orbiting scroll member 574 may not include the discrete protrusions 91, 93 shown in FIG. 3 or the continuous annular protrusion 491 shown in FIG. 7. Instead, the base surface 589 of the second region 586 of end plate 578 may form a valve seating region.

Primary discharge port 88 may be in communication with aperture 39 in partition 37 through aperture 138 in valve member 132 when valve member 132 is in the closed position. When in the open position, valve member 132 may be axially offset from end plate 78 and may abut valve stop 114 to provide communication between bypass porting 90, 92 and discharge passage 104 of hub member 76. Primary discharge port 88 may be in communication with aperture 39 in partition 37 when valve member 132 is in the open position. Therefore, primary discharge port 88 and bypass porting 90, 92 may each act as discharge ports when the valve member is in the open position.

Figure 5:
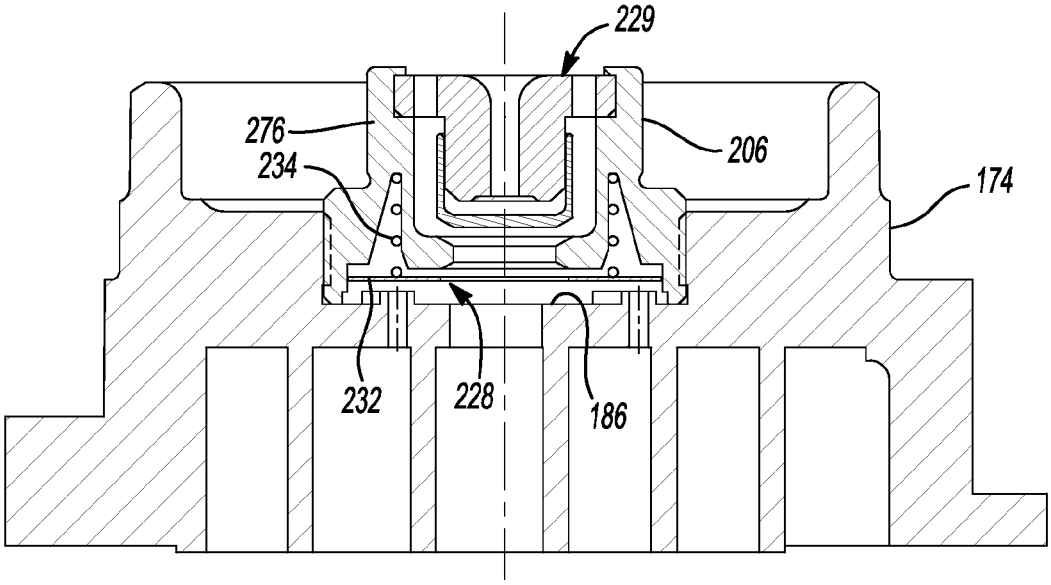
FIG. 5 is a section view of an alternate scroll assembly according to the present disclosure.

An alternate hub assembly including a hub member 276 and valve assembly 228 is shown in FIG. 5. Hub member 276 and valve assembly 228 may be generally similar to hub member 76 and valve assembly 28 discussed above. The hub member 276 and valve assembly 228 may be incorporated into the compressor 10 in place of the hub member 76 and valve assembly 28. However, hub member 276 may additionally include a discharge valve assembly 229 in first portion 206. Discharge valve assembly 229 may generally prevent a backflow of compressed gas or reverse rotation of the compressor 10 following shutdown.

During assembly of the arrangement shown in FIG. 5, the valve member 232 may initially be placed within the second region 186 of the non-orbiting scroll member 174. Next, the biasing member 234 may be located adjacent to the valve member 232. Finally, the hub member 276 may be attached to the non-orbiting scroll member 174. The arrangement of FIG. 5 provides for assembly without the use of a retainer for the valve member 232 similar to the retainer 130 shown in FIG. 4.

Figure 6:
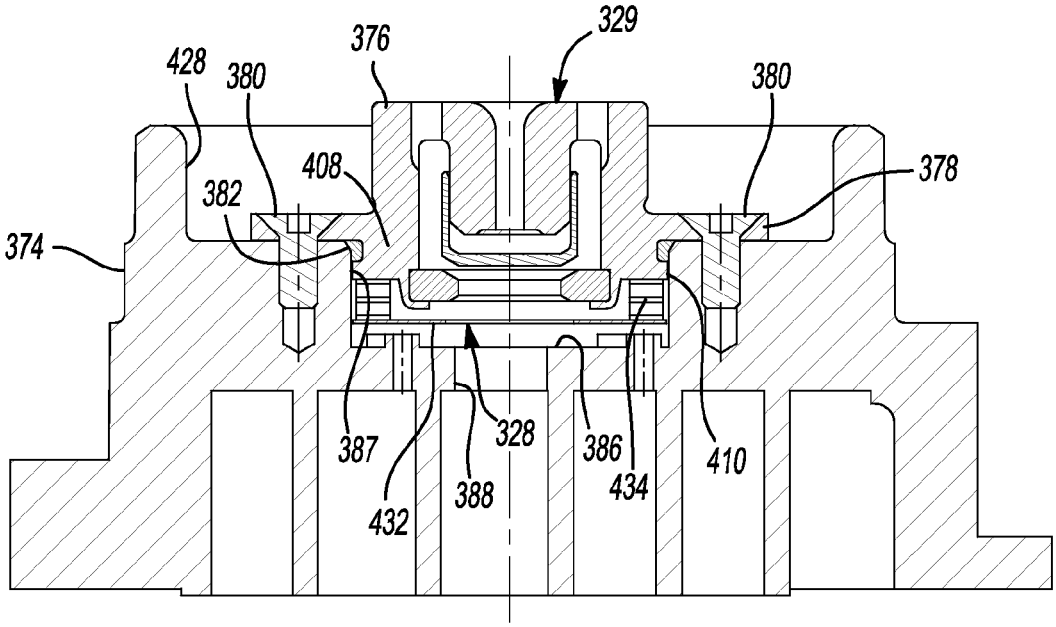
FIG. 6 is a section view of an alternate scroll assembly according to the present disclosure.

Another hub assembly including a hub member 376 and a valve assembly 328 is shown in FIG. 6. Hub member 376 may be generally similar to hub members 76, 276, discharge valve assembly 329 may be generally similar to discharge valve assembly 229 and valve assembly 328 may be generally similar to valve assemblies 28, 228. The hub member 376 and valve assembly 328 may be incorporated into the compressor 10 in place of the hub member 76 and valve assembly 28. However, hub member 376 may include a flange 378 and may be fixed to non-orbiting scroll member 374 by fasteners 380, such as bolts instead of a threaded engagement as discussed above. Therefore, an annular seal 382, such as an o-ring seal, may be located radially between the outer surface 410 of the second portion 408 of the hub member 376 and the wall 387 surrounding the primary discharge port 388 to isolate the primary discharge port from the annular chamber 428.

During assembly of the arrangement shown in FIG. 6, the valve member 432 may initially be placed within the second region 386 of the non-orbiting scroll member 374. Next, the biasing member 434 may be located adjacent to the valve member 432. Finally, the hub member 376 may be attached to the non-orbiting scroll member 374. The arrangement of FIG. 6 provides for assembly without the use of a retainer for the valve member 432 similar to the retainer 130 shown in FIG. 4.

Figure 9:
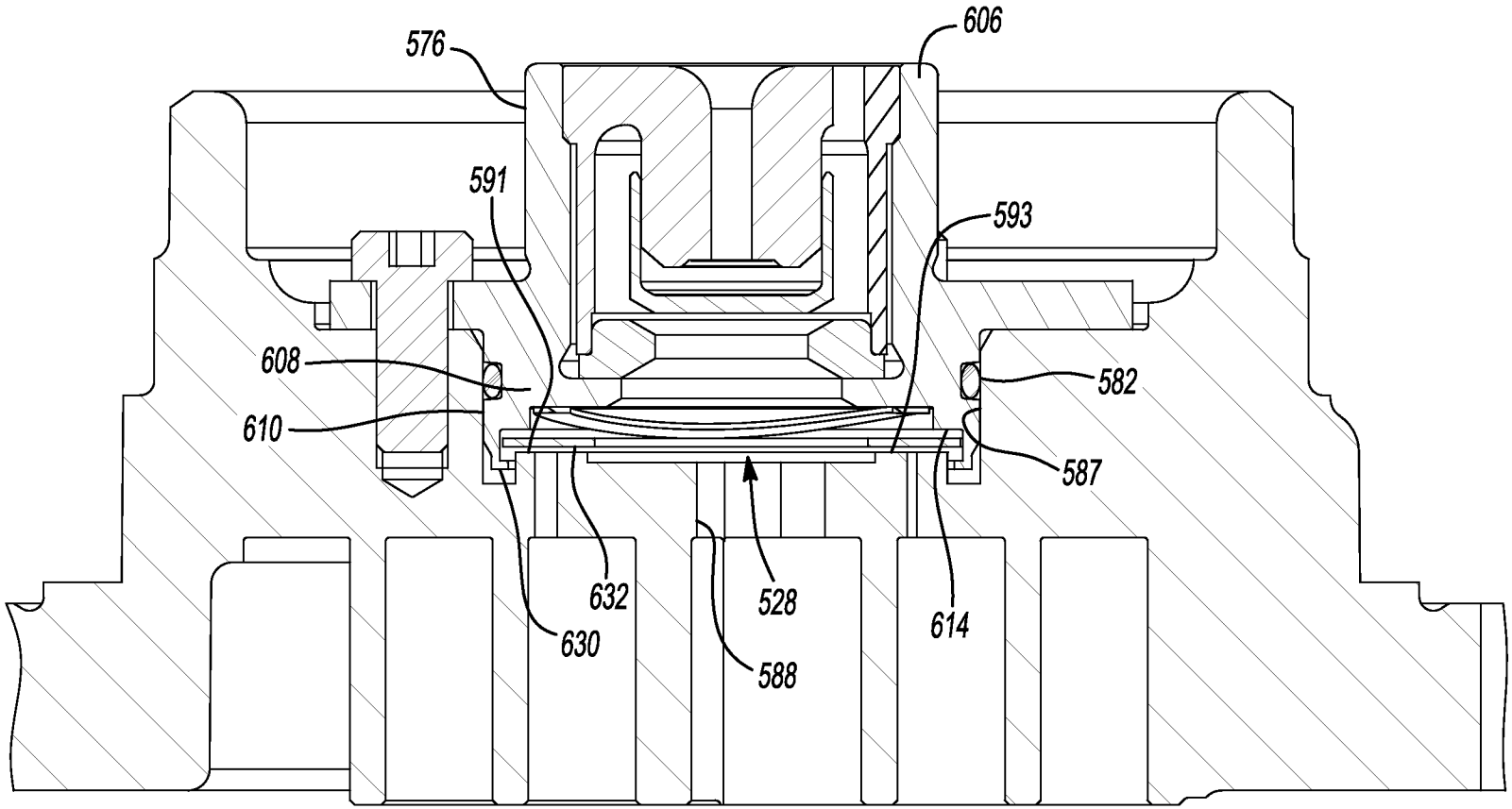
FIG. 9 is a section view of an alternate scroll assembly according to the present disclosure.

An additional alternate hub assembly including a hub member 576 and a valve assembly 528 is shown in FIG. 9. Hub member 576 may be generally similar to hub member 376 shown in FIG. 6 and may include an annular seal 582, such as an o-ring seal, located radially between the outer surface 610 of the second portion 608 of the hub member 576 and the wall 587 surrounding the primary discharge port 588. However, the second portion 608 of hub member 576 may include a retainer portion 630 at an end of the second portion 608 opposite the first portion 606 and adjacent to the non-orbiting scroll 574. Valve member 632 may be located and axially retained between the valve stop 614 and the retainer portion 630. Retainer portion 630 may have an axial thickness that is less than the height of the protrusions 591, 593 and may be located radially outward therefrom.

What is claimed is:

1. A compressor comprising:

a first scroll member including a first end plate having a first spiral wrap extending therefrom, said first end plate including a first annular wall surrounding a first region located radially within said first annular wall and a second region located radially within said first region and defining a recess, said first end plate further defining a discharge port and a first bypass port extending through said recess;

a second scroll member supported relative to said first scroll member and including a second end plate having a second spiral wrap extending therefrom and meshingly engaged with said first spiral wrap to form a suction pocket, intermediate pockets, and a discharge pocket, said discharge port being in communication with said discharge pocket and said first bypass port being in communication with one of said intermediate pockets;

a hub member secured to said first end plate and overlying an end surface defined by said second region, said hub member including a second annular wall defining a discharge passage in communication with said discharge port; and a valve member located between said end surface and said hub member and being displaceable between a closed position where said valve member prevents communication between said first bypass port and said discharge passage and an open position where said first bypass port is in communication with said discharge passage.

2. The compressor of claim 1, wherein said valve member includes an annular body defining an outer diameter greater than an inner diameter defined by said second annular wall and said second annular wall forms a valve stop for said valve member.

3. The compressor of claim 2, wherein said annular body defines an aperture aligned with said discharge port and providing communication between said discharge port and said discharge passage when said valve member is in the open and closed positions.

4. The compressor of claim 2, further comprising a valve retainer fixed to an end of said hub member opposite said second annular wall, said hub member defining a stepped region between said valve retainer and said second annular wall and said valve member being axially retained between said valve retainer and said stepped region.

5. The compressor of claim 4, wherein said valve retainer includes an annular body defining an inner circumference having a diameter less than said outer diameter of said valve member.

6. The compressor of claim 4, further comprising a biasing member axially retained within said hub member and biasing said valve member to the closed position.

7. The compressor of claim 4, further comprising a discharge valve fixed to said hub member within said discharge passage and displaceable between an open position allowing flow from said discharge port through said discharge passage and a closed position preventing flow from said discharge passage to said discharge port.

8. The compressor of claim 4, wherein a protrusion extends axially outward from said end surface of said recess and said first bypass port extends through said protrusion, said valve retainer located radially outward from said protrusion and having a thickness less than an axial extent of said protrusion.

9. The compressor of claim 8, wherein said valve retainer is located axially between said end surface and an end of said protrusion.

10. The compressor of claim 1, wherein said first end plate includes a stepped region defining a sidewall radially between said first and second regions, said sidewall including a threading engaged with a threading on an outer circumference of said hub member.

11. The compressor of claim 10, wherein said hub member includes a tool engagement region formed in an inner circumference of said second annular wall adapted to be rotationally driven by a tool to provide said threaded engagement.

12. The compressor of claim 1, wherein said hub member includes a flange extending radially outward from said second annular wall and overlying said first region, said hub member fixed to said first scroll member by a fastener extending through said flange and into said first end plate.

13. The compressor of claim 1, further comprising a seal assembly engaged with said first and second annular walls to define a biasing chamber, said first region including a biasing passage extending therethrough and in communication with one of said intermediate pockets.

14. A compressor hub assembly comprising:

a hub member including a first portion defining an annular hub wall for a compression member and having a first inner diameter, a second portion having a second inner diameter greater than the first inner diameter and defining a stepped region between said first and second portions;

a valve retainer fixed to said hub member at an end of said second portion opposite said stepped region and defining a third inner diameter; and a valve member located between said valve retainer and said stepped region and having an outer diameter less than the second inner diameter and greater than the first and third inner diameters.

15. The compressor hub assembly of claim 14, wherein an outer diameter of said first portion of said hub member is less than an outer diameter of said second portion defining an outer stepped region between said first and second portions.

16. The compressor hub assembly of claim 14, further comprising a discharge valve fixed to said hub member within said annular hub wall.

17. The compressor hub assembly of claim 14, wherein said second portion of said hub member includes a threading on an outer circumference thereof, said first portion including a tool engagement region in an inner circumference of said annular hub wall adapted to be rotationally driven by a tool.

18. The compressor hub assembly of claim 14, wherein said hub member includes a flange extending radially outward from said annular hub wall and including an aperture adapted to receive a fastener to fix said hub member to said compression member.

19. The compressor hub assembly of claim 18, wherein said compression member is a scroll member.

20. A method comprising:

providing a valve member within a hub member, the hub member including a first portion defining an annular hub wall for a compressor and having a first inner diameter and a second portion having a second inner diameter greater than the first inner diameter, the first and second portions defining a stepped region therebetween with the valve member being located within the second portion; and securing a valve retainer to an end of the second portion of the hub member to retain the valve member between the stepped region and the valve retainer.

21. The method of claim 20, further comprising coupling the hub member to a scroll member within an outer annular wall of the scroll member after said securing.

* * * * *